US005309692A

United States Patent [19]

Hayashi et al.

[11] Patent Number: 5,309,692

[45] Date of Patent: May 10, 1994

[54] METHOD FOR INJECTING REPAIRING AGENT INTO CONCRETE CONSTRUCTION

[75] Inventors: Yuichiro Hayashi; Noboru Naito; Osamu Ito, all of Sakata, Japan

[73] Assignee: Nihon Mente Kaihatsu Kabushiki Kaisha, Sakata, Japan

[21] Appl. No.: 56,933

[22] Filed: May 5, 1993

Related U.S. Application Data

[63] Continuation of Ser. No. 714,943, Jun. 13, 1991, abandoned.

[30] Foreign Application Priority Data

Jun. 30, 1990 [JP] Japan ..... 2-171381
Dec. 14, 1990 [JP] Japan ..... 2-410637

[51] Int. Cl.[5] ..... E04G 21/24

[52] U.S. Cl. ..... 52/743; 52/514; 405/269; 405/259.4

[58] Field of Search ..... 52/743, 744, 173 R, 52/514, 514.5; 405/266, 265, 269, 259.4; 411/15, 70, 352, 107; 29/402.9; 428/63; 156/44

[56] References Cited

U.S. PATENT DOCUMENTS

| | | | |
|---|---|---|---|
| 3,017,799 | 1/1962 | Lemoine | 405/259.4 |
| 4,001,989 | 1/1977 | Fischer | 52/743 X |
| 4,260,295 | 4/1981 | Vestlund | 405/269 |
| 4,270,331 | 6/1981 | Lang et al. | 52/744 |
| 4,601,614 | 7/1986 | Lane et al. | 405/269 X |
| 4,656,806 | 4/1987 | Leibhard et al. | 411/15 |
| 4,992,004 | 2/1991 | Haug | 405/269 |
| 5,033,952 | 7/1991 | Haug | 405/269 X |
| 5,063,006 | 11/1991 | Tahara | 52/514 X |

FOREIGN PATENT DOCUMENTS

| | | | |
|---|---|---|---|
| 0776251 | 6/1957 | United Kingdom | 405/259.4 |
| 2204905 | 11/1988 | United Kingdom | 52/744 |

*Primary Examiner*—Carl D. Friedman
*Assistant Examiner*—Kien Nguyen

[57] ABSTRACT

An injection plug device for injecting a concrete repairing agent into a concrete construction through an arcuate injection groove formed therein. The plug device includes a base member sealingly placed over an open end of the arcuate injection groove, a plurality of guide posts extending from the base member, an equal plurality of rod members extending through the guide posts, and engageable member selectively engageable with side walls of the arcuate injection groove by resilient deformation. The engageable members are provided at an inner end portion of the guide posts, or an external surface of the inner end portions of the guide posts. The engageable members have a width smaller than a width of the arcuate injection groove prior to their deformation and have another width larger than the width of the arcuate injection groove after their deformation to provide engagement with the side wall of the groove. The injection plug device is used for achieving a method for injecting a concrete repairing agent into the concrete construction. The method includes the steps of forming the arcuate injection groove, placing the base member over the open end of the injection groove in placing the injection plug device on the concrete construction, and engaging the engageable member with the groove for fixing the plug device to the concrete construction.

6 Claims, 10 Drawing Sheets

10 (11)

METHOD FOR INJECTING REPAIRING AGENT INTO CONCRETE CONSTRUCTION

This is a continuation of application Ser. No. 07/714,943 filed Jun. 13, 1991 now abandoned.

BACKGROUND OF THE INVENTION

The present invention relates to a concrete injection plug for repairing a concrete construction, and to a method for injecting a remedial concrete material into a portion of the concrete construction.

Degradation of concrete material of a concrete construction is a considerable problem. The degradation may be caused by a secular change in the material per se, neutralization of the concrete due to external circumstance, injury from salt, alkali-aggregate reaction, unsatisfactory work or execution, shrinkage due to drying, generation of crack or peeling-off due to vibration from vehicles or an earthquake. A reduction in the mechanical strength of reinforcements due to their rusting accompanied by the peeling-off is also a source of degration. The degradation of the concrete may also include separation of a furring mortar formed over the concrete body therefrom, which in turn leads to falling of the skin tiles of a building formed over the furring mortar, or separation and falling of an internal concrete wall of a railway tunnel or the like, or water leakage from a dam.

Also, a separation space layer may be formed between an inner concrete body and an outer mortar layer at a position from 2 to 3 cm from a wall surface. A typical thickness of the separation space layer is in a range of from 0.2 to 1 mm. In order to repair a wall containing such a separation space layer, epoxy resin or a cement slurry injection method has been widely carried out in order to fill the space therewith.

According to a conventional epoxy resin injection method, an injection hole having a diameter of about 5 mm and reaching the separation space layer is formed on the wall by means of a drill. Then, a sleeve tip of a grease pump is depressed into the injection hole so as to directly inject the high pressure epoxy resin thereinto. Alternatively, an injection plug formed of a plastic material is adhesively fixed to the injection hole of the wall, and the pressurized epoxy resin is injected by a compressor or a manual pump. In both cases, any crack portions observed on a surface of the wall, other than the injection hole, are sealed by a sealant.

On the other hand, the above described high pressure grease pump cannot be used for the injection of the cement slurry, since the latter has relatively low viscosity. For example, if the grease pump capable of providing high fluid pressure such as 30 kg/cm$^2$ is used, the cement slurry may be leaked through a minute gap defined between the injection hole and the tip end of the sleeve of the pump, to thereby render the pressurization impossible. To this effect, a low pressure injection method is applied where a pressure of not more than 5 kg/cm$^2$ is applied for the injection of the cement slurry. Incidentally, this low pressure injection method is also available for the epoxy resin.

In case of the low pressure injection method for injecting the cement slurry or the epoxy resin, the injection hole is formed on the concrete wall by means of a drill, and a flange portion of the plastic plug is adhesively fixed to a position around the injection hole. Further, an injection hose extending from the injection pump is engaged with a rear mouth piece portion of the plastic plug, so that the cement slurry or the epoxy resin is injected under pressure through the injection hole into the desired internal crack portion of the concrete wall.

This plastic plug has a funnel shape having a diameter of about 5 cm and is readily available. Adhesive material is used for fixing the plug to the wall surface. However, since the adhesive force is insufficient preventing the plug from being separated from the wall during pressurized injection, additional operators are required for pressing the plug onto the wall surface in addition to an operator for operating the pressure pump.

In order to dispense with the worker who has to press the plug onto the wall surface, anchor type injection plug (hole-in-anchor type injection plug) have been employed. This plug has an anchoring or wedge function. Therefore, the anchor type injection plug can be fixedly secured to the wall by hammering the plug into the drilled injection hole. Thus, a release of the injection plug from the wall is avoidable even during the injection work.

With the above described low pressure injection method using the conventional injection plug, it would be difficult to perform injection of the cement slurry in comparison with the injection of the epoxy resin. Therefore, in injecting the cement slurry, injection holes are formed at many places corresponding to portions where the separating of the mortar is deemed to occur. Therefore, it requires much labor and time. In the worst case, epoxy resin must be used instead of the cement slurry for the concrete repair, where many injection holes cannot be located.

SUMMARY OF THE INVENTION

The inventors have conducted experiments for acknowledgement of any factor which prevents the cement slurry from being smoothly injected. Firstly, prepared were a mortar plate having a size of 30 cm×30 cm and a thickness of 3 cm, the mortar plate being simulative of a mortar layer, and a transparent acrylic layer having a size of 30 cm×30 cm and a thickness of 1 cm, the acrylic layer being a simulative of an internal concrete wall body. These two plates were opposed to each other with a space of 0.3 mm defined by spacers (the space being simulative of the separation space layer), and four sides of these plates were clamped together. Then, a small bore having a diameter of 6 mm, is simulative of the injection hole, was formed at a central portion of the mortar plate by means of a drill. In this case, immediately before a drill tip reached the acrylic plate, the mortar plate was bored by the drilling force, and observed was a phenomena in which a conical mortar chip having a diameter of about 5 mm and thickness of 3 mm at its central portion was protruded and brought into intimate contact with the acrylic plate, and the drilled mortar chip was interposed at the spaced gap defined between the acrylic and mortar plates.

A cement slurry was injected into the spaced gap through the small bore by using a manual pump. However, it was impossible to inject the slurry into the gap. If these two plates were unclamped from each other for investigation, it was observed that a minute amount of water infiltrated into the mortar chip from its rear surface (a surface opposite the acrylic plate side), and the surface was covered with cement particles.

This phenomena appears to be caused by the following: When forming the bore, the thin mortar drilled chip was formed, and its tip end (a chip surface confronting the acrylic plate) was brought into intimate contact with the acrylic plate. On the other hand, extremely minute gaps were provided between the mortar plate and another end of the mortar chip. This means that the internal gap space was not sufficiently communicated with the drilled bore. Since the injection was made from the mortar plate side, the cement slurry was subjected to filtering at the extremely minute gaps provided at the other end of the mortar chip, so that minute amount of water infiltrated into the drilled mortar chip and the trapped cement particles were accumulated on the other surface of the chip mass and closed or filled up the extremely minute gap. Thus, cement slurry cannot be further injected into the intended gap between the mortar plate and the acrylic plate. In this connection, after the drilled mortar chip was removed, and the two plates were again assembled together, the cement slurry was smoothly injected into the gap through the small bore since the small bore was adequately communicated with the internal gap space.

In an actual application, the cement slurry could be injected through one of the several injection holes. This was due to the fact that the drilled hole was casually communicated with the large space separation layer, so that the drilled mortar mass chip did not substantially largely close the drilled injection hole. Further, the injection with the epoxy resin was still attainable, since the resin does not contain particulate materials. In other words, the resin does not undergo filtering at the other side of the drilled conical mortar chip because of the nonexistence of particulate materials in contrast to the cement slurry.

In order to obviate the generation of the mortar chip mass, various hole forming machines were used such as a well core boring machine. However, it was impossible to eliminate the generation of mortar chips.

Therefore, it is an object of the present invention to overcome the above described drawbacks and disadvantages, and to provide an improved method for injecting repairing material into a concrete construction, the method being capable of eliminating problems attendant to the generation of the mortar chip mass which may close the separation space layer and may block communication between the separation space layer and the drilled injection hole.

Another object of the invention is to provide an injection method in which a labor for the concrete repairing can be reduced, and remedial maintenance to the concrete construction can be achieved with a high reliability and minimized labor and time.

Still another object of the invention is to provide an improved injection plug device for injecting repairing material into the concrete construction, the plug device being particularly available for the injection method of this invention.

Still another object of the invention is to provide such an injection plug device at low cost yet available for the injection method of this invention.

Still another object of the invention is to provide an injection plug device which is fixedly securable to the concrete wall.

These and other objects of the present invention will be attained by providing a plug device for an injecting repairing agent into a concrete construction, the concrete construction being formed with an injection groove having a first width, the plug device comprising a base member to be mounted on an outer surface of the concrete construction and over the injection groove, an injection guide means provided at a center portion of the base member for allowing the repairing agent to be injected into the injection groove, at least two guide posts extending from the base member and at positions around the injection guide means, the guide posts providing through holes and having an inner end portion, an equal plurality of rod members each extending through each of the through holes, each of the rod members being movable inwardly into the injection groove and outwardly from the concrete construction, each of the rod members having inner and outer end portions, and resilient engageable members provided at the inner end portions of one of the rod members and the guide posts, each of the resilient engageable member having a second width smaller than the first width prior to its deformations and a third width larger than the first width for engagement with walls of the injection groove after its deformation.

In another aspect of the invention, there is provided a method for injecting a concrete repairing agent into a concrete construction comprising the steps of forming an arcuate injection groove from an outer surface of the concrete construction, the arcuate groove having a first width and a depth, placing an injection plug device which injects the repairing agent into the concrete construction onto the outer surface of the concrete construction and over the injection groove, fixing the injection plug device to the arcuate injection groove while sealingly covering the arcuate injection groove, and injecting the repairing agent into the injection groove through the injection plug device.

BRIEF DESCRIPTION OF THE DRAWINGS

In the drawings;

FIG. 3(*b*) is a plan view of the toothed washer;

FIG. 9(*b*) and 9(*c*) are cross-sectional view and bottom view of the toothed grip post, respectively;

FIG. 10(*b*) and 10(*c*) are cross-sectional view and bottom view of the trapezoidal slide piece;

FIG. 13(*b*) is a front view showing the toothed washer shown in FIG. 13(*b*);

FIG. 13(*c*) is a front view showing another example of a toothed washer used in the third embodiment;

FIG. 14(*b*) is a front view showing the modified toothed washer after assembling to the modified rod member:

FIG. 14(*c*) is a front view showing the modified toothed washer prior to the assembly to the modified rod member:

DETAILED DESCRIPTION OF THE PREFERRED EMBODIMENTS

Figure 1:
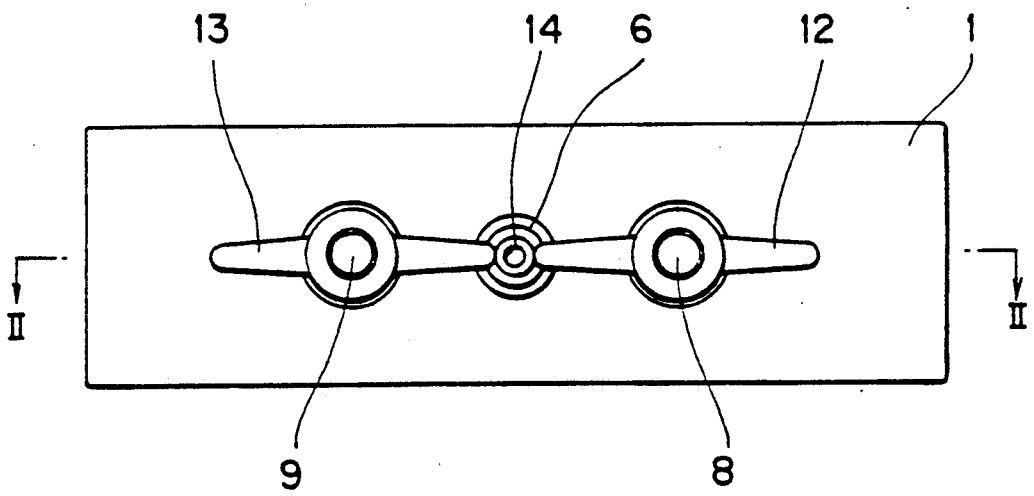
FIG. 1 is a plan view showing a plug device for injecting a concrete repairing material according to a first embodiment of this invention.
Figure 2:
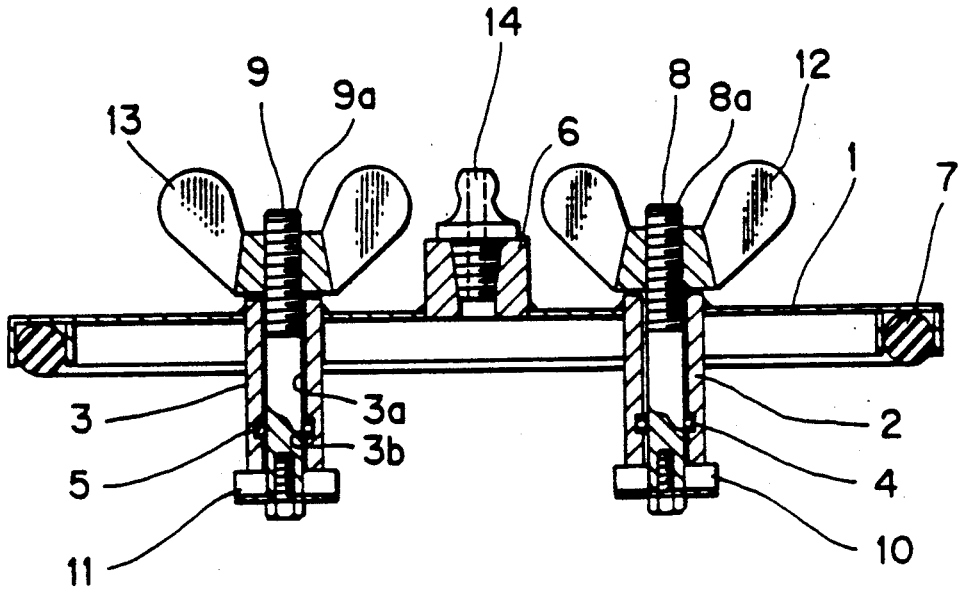
FIG. 2 is a cross-sectional view taken along a line II—II in FIG. 1.

A plug device for injecting a concrete repairing material according to a first embodiment of the present invention will be described with reference to FIGS. 1 through 6. As best shown in FIG. 2, the plug device generally includes a rectangular base 1, cylindrical hollow guide posts 2, 3, O-rings 4, 5, an injection nipple attachment segment 6, a packing 7, rod members 8, 9, toothed washers 10, 11, wing nuts 12, 13 and a repairing agent injection nipple 14.

The rectangular base 1 has four side portions bent downwardly, so that the base 1 has a bottomless box shape construction. Throughout the description, one side of the base 1 is referred to as an outer side, and another side of the base 1 (the side at which the bent portions extend) is referred to as an inner side. The packing 7 is formed of rubber and is positioned at the inner side of the base 1 and in the vicinity of the side portions thereof. At the central portion of the rectangular base 1, the nipple attachment segment 6 is implanted and welded, and the repairing agent injection nipple 14 is threadingly engageable with the attachment segment 6 for injecting a cement slurry. For example, the injection nipple 14 is connectable with an injection nozzle (not shown) of an injection pump (not shown) for injecting concrete repairing agent such as cement slurry.

On the base 1, two cylindrical hollow guide posts 2 and 3 are implanted and welded. The guide posts are formed of metal, and arrayed in a direction parallel with a major side of the rectangular base 1 and positioned symmetrical with respect to the nipple attachment segment 6. The guide posts 2 and 3 extend inwardly from the base 1. Further, female threads 2*a* and 3*a* are formed in inner peripheral surfaces of the hollow cylindrical guide posts 2, 3, respectively, and annular grooves 2*b* and 3*b* are formed at the inner portion of the inner peripheral surfaces so as to secure the O-rings 4 and 5, respectively.

Figures 3A, 3B:
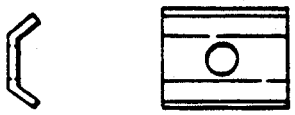
FIG. 3 (*a*) is a side view showing a toothed washer which is one of the components of the plug device of the first embodiment.

The rod members 8 and 9 extend through the hollow spaces of the cylindrical guide posts 2 and 3, respectively. Thus, cylindrical annular spaces defined between the rod members 8, 9 and the guide posts 2, 3 are fluid-tightly sealed by the O-rings 4, 5. Inner end portions of the rod members 8 and 9 further project out of the inner end of the guide posts 2 and 3. Further, the toothed washers 10 and 11 are threadingly engaged with the projected inner end portions of the rod members 8 and 9, respectively. The toothed washers 10, 11 are formed of resilient material such as spring steel. As best shown in FIGS. 3(*a*) and 3(*b*), the washers 10, 11 have rectangular configurations, and their two sides are bent so as to constitute anchor portions. When the washers are engaged with the inner ends of the rod members 8, 9, the bent portions are directed outwardly. Another end portions of the rod members 8 and 9 are formed with male threads 8*a*, 9*a* so that the wing nut 12 and 13 are threadingly engageable therewith at the outer side.

Figure 4:
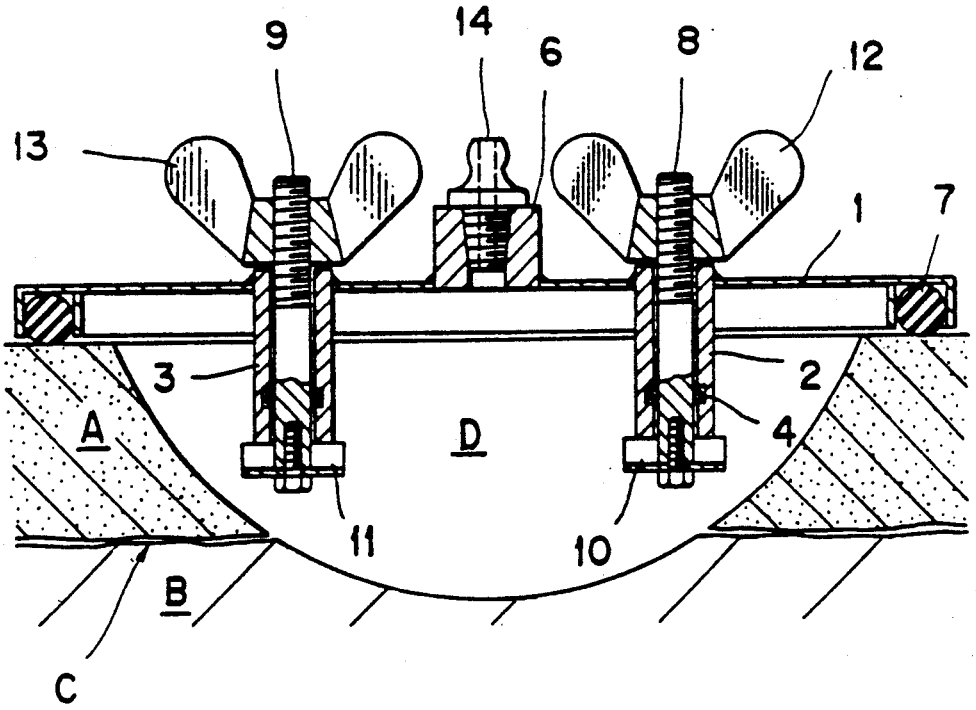
FIG. 4 is a cross-sectional view showing the plug device according to the first embodiment and showing a concrete wall construction to which the plug device is applied.
Figure 5:
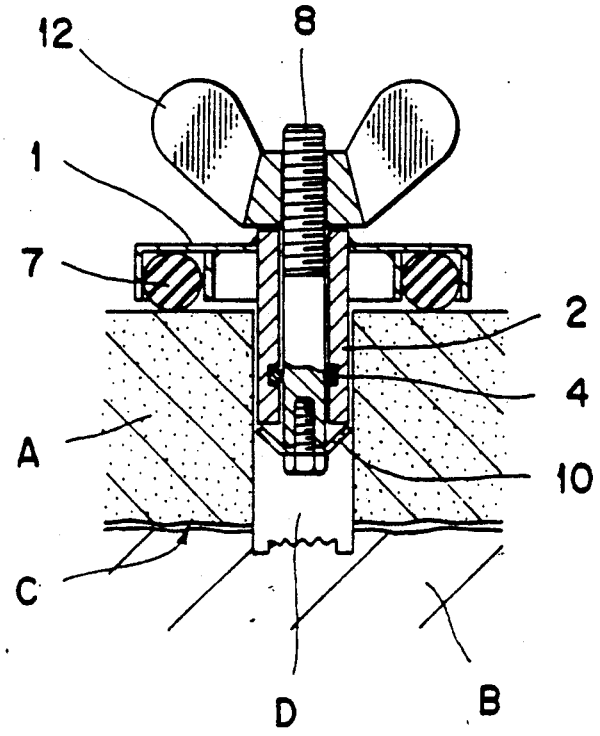
FIG. 5 is a cross-sectional view showing the plug device according to the first embodiment prior to its fixed state to the concrete construction.
Figure 6:
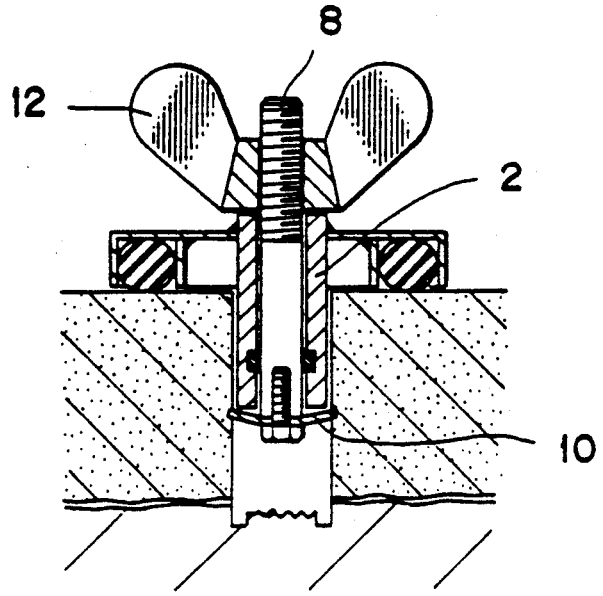
FIG. 6 is a cross-sectional view showing the plug device according to the first embodiment after its fixed state to the concrete construction.

Next, will be described with reference to FIGS. 4 through 6 a method for injecting the concrete repairing agent into the concrete construction with the employment of the injection plug device described above.

As shown, the concrete construction includes an internal concrete body B and an external mortar layer A. Further, a separation space layer C is provided at a boundary between the concrete body B and the mortar layer A. The repairing agent is to be filled into the space layer C.

Firstly, an injection groove D is formed from the outer side of the concrete construction. The groove D has generally arcuate or semicircular shape and the groove bottom reaches the separation space layer C (see FIG. 4). Further, as best shown in FIG. 5, the groove has a predetermined width slightly larger than a width of the toothed washer 10, 11 and outer diameters of the guide posts 2, 3. In order to form the arcuate or semicircular injection groove D, two cutting grooves extending in parallel with each other are initially formed by a circular concrete saw or blade, and then, the concrete construction is smashed by a hammer so as to smash the mortar layer portion between the two cutting grooves. The smashed pieces or chips are then removed by air suction means. Incidentally, the two cut grooves are formed by operating twice a concrete cutter having a single circular saw. However, a dual blade type concrete cutter as described in a Japanese Patent Application No. Hei 1-274028 is available for facilitating the formation of two cut grooves extending in precise parallelism with each other with a precise spaced distance therebetween.

Figure 18:
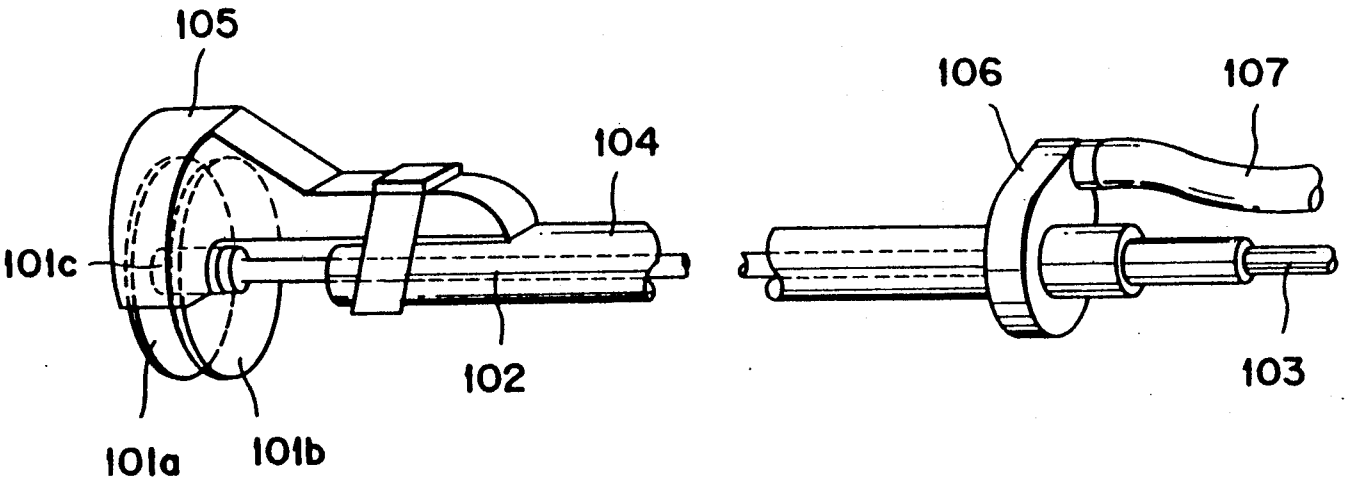
FIG. 18 is a perspective view showing a dual blade type concrete cutter for forming an arcuate injection groove in the concrete construction.

More specifically, as shown in FIG. 18, the dual blade type concrete cutter includes two circular saw blades 101*a*, 101*b*, a spacer 101*c*, a spindle 102, a flexible shaft 103, a hand held pipe 104, a chip collection cover 105, a chip suction duct 106, and a flexible chip collection hose 107. The hand held pipe 104 is formed of a light weight material such as a light metal and carbon, and the two circular saw blades 101*a* and 101*b* are replaceably supported on a tip end portion of the hand held pipe 104. These blades 101*a*, 101*b* extend in parallel with each other with a space therebetween defined by the spacer 101*c*. These blades are accessible in a market as a cutting blades for cutting a surface of a concrete or asphalt road, the blade being a product by Sankyo Diamond Kogyo Kabushiki Kaisha. These cutters are driven through the spindle 102 and the flexible shaft 103 by a portable drive means (not shown). The concrete chips or powders generated during the cutting work are impinged on the cover 105, and is sucked through the hand held pipe 104, the chip suction duct 106 and the flexible chip collection hose 107 into a chip collection bag (not shown) upon energization of a suction blower (not shown).

Next, the guide posts 2, 3 are inserted into the arcuate groove D for setting the plug device to the concrete construction. Prior to the setting, the wing nuts 12, 13 are rotated in one direction (counterclockwise direction) so that the inner ends of the rod member 8, 9 are moved away from the inner ends of the guide posts 2, 3, to thereby move the toothed washers 10, 11 away from the inner ends of the guide posts 2, 3 in order to obtain the washer shape as shown in FIG. 3(*a*). Accordingly, a width of the toothed washer can be made smaller than that of the arcuate groove D for facilitating insertion of the washer and guide posts into the arcuate groove D.

Upon completion of the insertion of the guide posts 2, 3 into the arcuate groove D, the wing nuts 12, 13 are rotated in opposite direction (clockwise direction) so that the rod members 8, 9 are moved outwardly. Therefore, the bend anchor or toothed portions of the toothed washers 10, 11 are brought into contact with the inner ends of the cylindrical guide posts 2, 3 and are further urged. Thus, the bending angle of the bent portions is decreased so that the toothed washers can have a generally flat shape as shown in FIG. 6. Accordingly, the width of the washers 10, 11 is increased and becomes larger than the width of the arcuate groove D. Consequently, the initially bent portions are thrusted into the side walls of the arcuate groove D so as to perform an anchoring function, and as a result, the plug device can be fixedly secured to the concrete construction. If the wing nuts 12, 13 are further rotated, the packing 7 is firmly urged onto the outer surface of the mortar layer A, to thereby avoid leakage of the concrete repairing agent through the packing portion.

Then, the injection nozzle (not shown) of the injection pump (not shown) is connected to the injection nipple 14 for injecting the concrete repairing agent such as the cement slurry under pressure into the separation space layer C. Upon completion of the injection, the injection nozzle is detached from the injection nipple 14, and the wing nuts 12, 13 are rotated in one direction. By this rotation, the rod members 8, 9 are moved inwardly, so that the toothed washers 10, 11 are also moved inwardly. By this movement, the anchoring portion of the toothed washers 10, 11 are disengaged from the walls of the arcuate groove D, and the washers 10, 11 restore their original bent configurations. Thereafter, the plug device is disassembled from the concrete construction for completing the injection work.

An injection plug device for injecting a concrete repairing material according to a second embodiment of the present invention will next be described with reference to FIGS. 7 through 10 wherein like parts and components are designated by the same reference numerals and characters as those shown in the first embodiment. This plug device is provided with toothed grip posts 20, 30 (30 not shown) instead of the guide posts 2, 3 of the first embodiment, and is also provided with trapezoidal slide pieces 21, 31 (31 not shown) provided at the inner ends of the rod members instead of the toothed washers 10, 11 of the first embodiment. In the depicted drawings, the second toothed grip post 30 and trapezoidal slide piece 31 are not shown for purposes of simplicity.

Figure 9A:
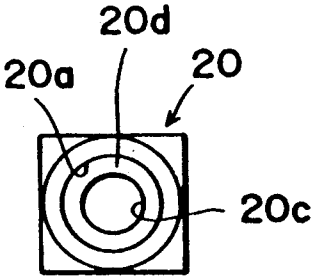
FIG. 9(*a*) is a plan view of a toothed grip post which is one of the essential components of the plug device according to the second embodiment.
Figure 9B:
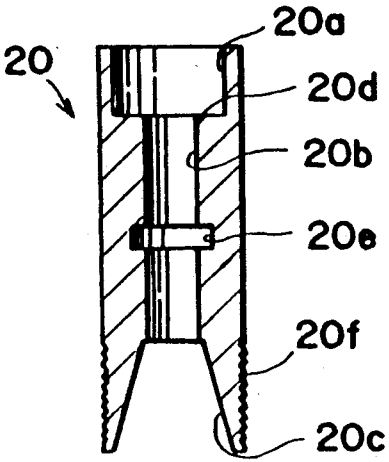
Figure 9C:
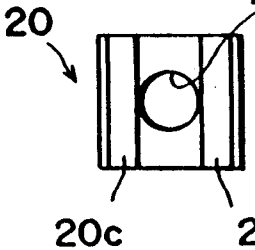

FIGS. 9(*a*) through 9(*c*) illustrate the detailed arrangement of the toothed grip post 20 fixedly connected to the base 1 (see FIG. 7) similar to the first embodiment. The toothed grip post 20 has a square cross-section and is formed with a through hole for allowing a rod member 28 to pass therethrough. The through hole has an outer large inner diameter portion 20*a*, an intermediate small inner diameter portion 20*b* and an inner tapered portion 20*c*. The boundary between the outer and intermediate inner diameter portions 20*a* and 20*b* defines a stepped portion 20*d*, and the intermediate small diameter portion 20*b* is formed with an annular groove 20*e*. A ring 29 is fitted with the large inner diameter portion 20*a* for preventing the rod member 28 from releasing from the grip post 20. The tapered portion 20*c* is contiguous with the inner end of the small inner diameter portion 20*b*, and has an increasing inner diameter toward the inner end of the grip post 20.

At the inner portion and at two external sides of the grip post 20, a rack-form surface of irregular portions 20*f* are formed to be engageable with the side walls of the arcuate groove D. The width of the grip post 20 in a direction parallel with the minor side of the rectangular base 1 is made slightly smaller than the width of the arcuate injection groove D. The grip post 20 is formed of highly resilient material such as spring steel so that it can be resiliently deformable in accordance with the enlarging function given by the trapezoidal slide piece 21 described later.

Figure 7:
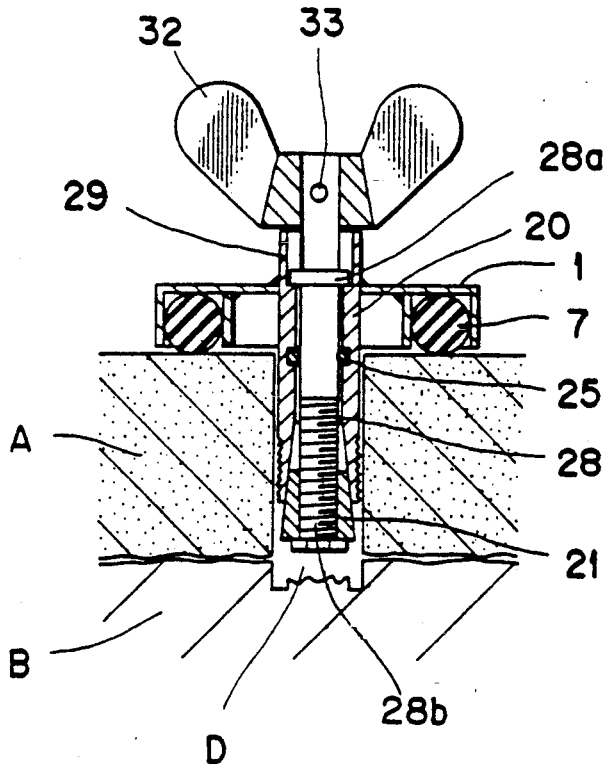
FIG. 7 is a cross-sectional view showing a plug device according to a second embodiment prior to its fixed state to a concrete construction.

As shown in FIG. 7, the rod member 28 has an outer end portion to which a wing nut 32 is integrally attached by means of a pin 33. The rod member 28 has an intermediate portion provided with a flanged portion 28*a* abuttable on the stepped portion 20*d*. Further, an O-ring 25 is accommodated in the annular groove 20*e* of the grip post 20 for sealing purpose in connection with the inserted rod member 28. The rod member 28 has an inner end portion formed with a male thread 28*b* with which the trapezoidal slide piece 21 is threadingly engageable. By the rotation of the wing nut 32, the rod member 28 is rotated about its axis, so that the slide piece 21 are moved in the axial direction of the rod member 28.

Figure 10A:
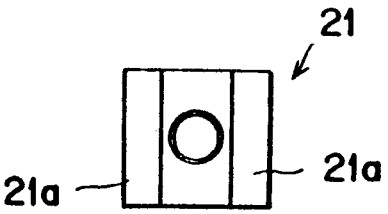
FIG. 10(*a*) a plan view showing a trapezoidal slide piece which is also one of the essential components of the plug device according to the second embodiment.
Figure 10B:
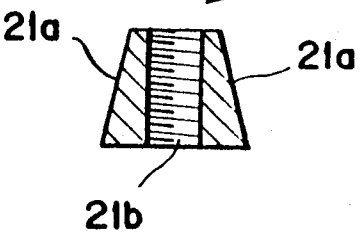
Figure 10C:
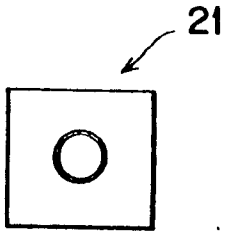

The details of the trapezoidal slide piece 21 are shown in FIGS. 10(*a*) thru 10(*c*). The slide piece 21 has tapered surface 21*a* having an inclination identical with that of the tapered portion 20*c* of the grip post 20. Thus, the trapezoidal configuration is provided. The slide piece 21 has an inner thread bore 21*b* for threading engagement with the male thread 28*b* of the rod member 28. In accordance with the axial movement of the slide piece 21, the tapered surface 21*a* in contact with the tapered surface 21*a* can expand or reduce the inner end portion of the grip post 20 in a direction indicated by an arrow X in FIG. 9(*b*).

Figure 8:
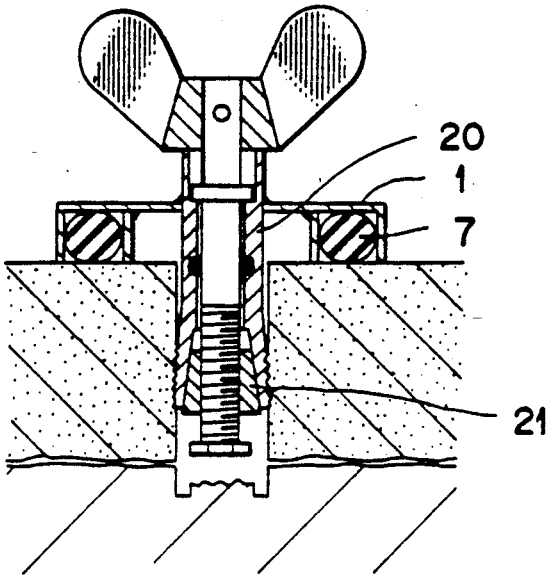
FIG. 8 is a cross-sectional view showing the plug device according to the second embodiment after its fixed state to the concrete construction.

Next, a method for injecting the concrete repairing agent into the concrete construction with the employment of the injection plug device according to the second embodiment of this invention will be described with reference to FIGS. 7 and 8. Initially, the arcuate injection groove D is provisionally formed as described above.

For assembling the plug device to the concrete construction, as shown in FIG. 7, the wing nut 32 is rotated in a counterclockwise direction for moving the trapezoidal slide piece 21 inwardly. Therefore, distance between the two rack-form deformable portions is made smaller than the width of the injection groove D. Accordingly, the toothed grip post 20 can be inserted into the injection groove D.

Next, the rod member 20 is rotated about its axis in a opposite direction by rotating the wing nut 32 in a clockwise direction. Therefore, the trapezoidal slide piece 21 is moved outwardly while sliding with respect to the tapered portion 20*c*. Thus, the tapered portion 20 is resiliently deformed in the direction indicated by the arrow X, so that the rack-form surface of irregular portions 20*f* are brought into biting engagement with the side walls of the injection groove D as shown in FIG. 8. Consequently, the plug device can be fixed to the concrete construction. By further rotating the wing nut 32 in the clockwise direction, the packing 7 is further urged toward the surface of the mortar layer A, to thus avoid leakage of the concrete repairing agent from the packing 7.

A plug device for injecting a concrete repairing material according to a third embodiment of the present invention will next be described with reference to FIGS. 11 through 17. The plug device according to the third embodiment is provided with a metallic rectangular base 41, cylindrical guide posts 42, 43, O-rings 44, 45, an injection nipple attachment segment 46, a packing 47, rod members 48, 49, toothed washers 50, 51, wing nuts 52, 53 and an injection nipple 54.

Figure 11:
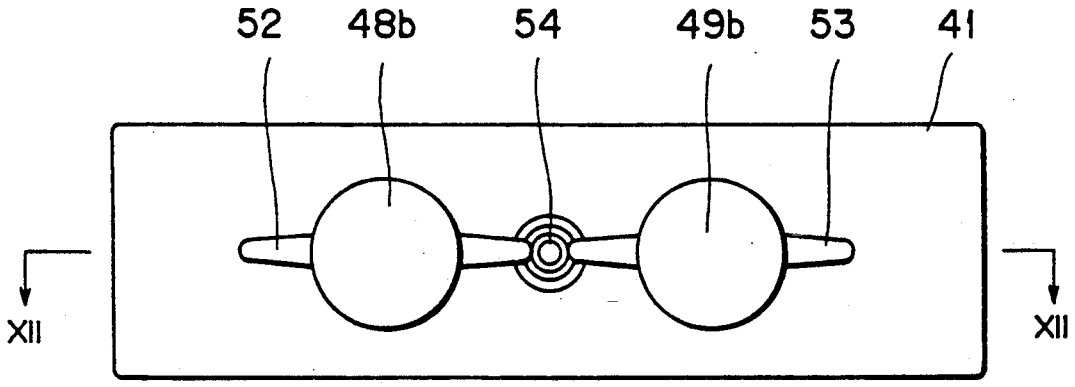
FIG. 11 is a plan view showing a plug device for injecting a concrete repairing material according to a third embodiment of this invention.

As shown in FIG. 11, the rectangular base 41 has four sides bent inwardly to provide a bottomless box shape similar to the foregoing embodiments. Further, the nipple attachment segment 46 is implanted to the central portion of the base 41, and the injection nipple 54 is threadingly engaged with the nipple attachment segment 46 similar to the foregoing embodiments for introducing a cement slurry therethrough. Further, the metal guide posts 42 and 43 are arrayed in a direction parallel with major sides of the rectangular base 41 and at positions opposite to each other with respect to the nipple attachment segment 46. The guide posts 42 and 43 are welded to the base 41. The packing 47 is held on the inner side of the rectangular base 41. Contrary to the first embodiment, these guide posts 42 and 43 extend outwardly from the base 41.

Figure 12:
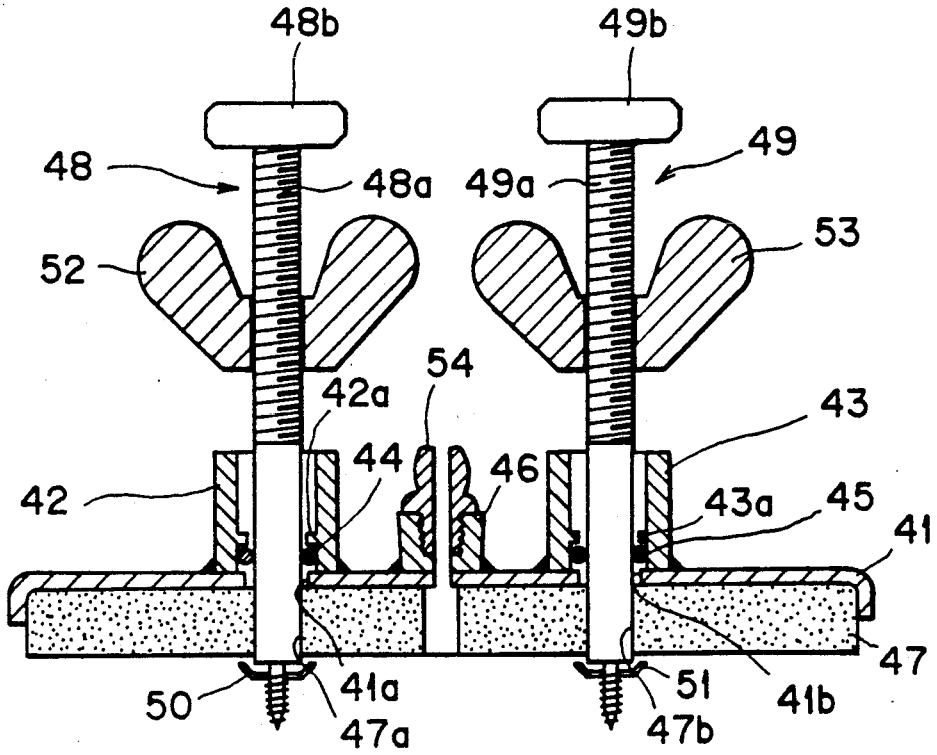
FIG. 12 is a cross-sectional view taken along a line XII—XII in FIG. 11.

As best shown in FIG. 12, the inner end portions of the rod members 48, 49 extend through the guide posts 42, 43 and further extend inwardly through openings 41*a*, 41*b* formed in the base 41 and openings 47*a*, 47*b* formed in the packing 47, respectively, and protrude inwardly out of the packing 47. The protruded inner end portions of the rod members 48, 49 are detachably provided with toothed washers 50, 51, respectively. On the other hand, outer end portions of the rod members 48, 49 are formed with male threads 48*a*, 49*a* with which wing nuts 52, 53 are threadingly engageable, respectively. Further, at the outermost ends of the rod members 48, 49, hand grips 48*b* and 49*b* are provided for manually moving the rod members in their axial direction.

Further, as shown in FIG. 12, root or base end portions of the guide posts 42, 43 are provided with annular projections 42*a*, 43*a* extending radially inwardly from inner peripheral surfaces of the posts. Thus, annular regions are defined by the combinations of a lower surfaces of the annular projection 42*a*, 43*a*, the inner peripheral surfaces of the guide post 42, 43, outer peripheral surfaces of the rid members 48, 49, and a top surface of the base 41. Within the annular regions, seal rings 44 and 45 are interposed, so that the fluid tight construction can be provided in connection with the guide posts 42, 43 and the rod members 48, 49.

Figure 13A:
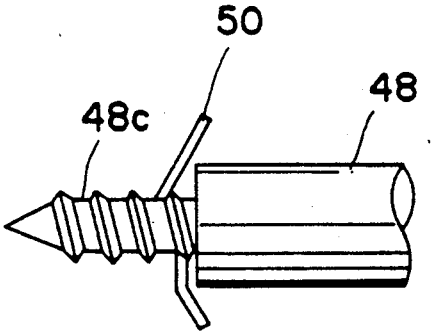
FIG. 13 (*a*) is a schematic side view showing a tip end portion of a rod member and a toothed washer assembled thereto in the third embodiment of this invention.
Figure 13B:
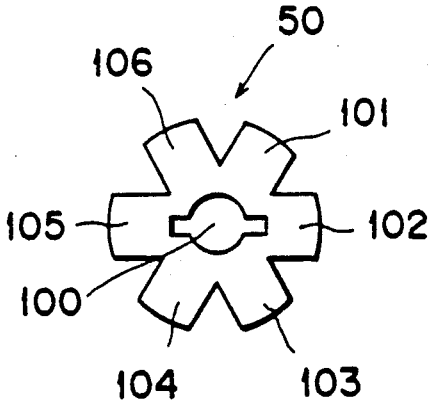
Figure 13C:
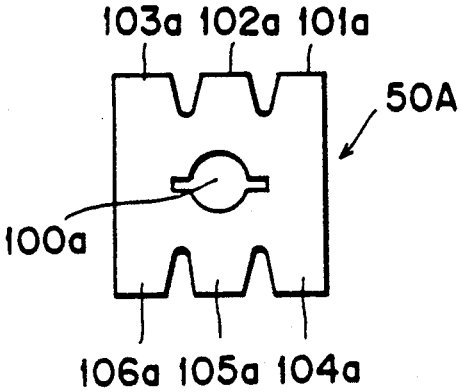

FIGS. 13(*a*) and 13(*b*) show one example of the toothed washer 50 provided on the inner end portion of the rod member 48, and FIG. 13(*c*) shows one modification to the toothed washer. As shown in FIG. 13(*a*), the inner end portion (tip end portion) of the rod member 48 is formed with a spiral groove 48*c* with which the toothed washer 50 is engaged. The toothed washer 50 shown in FIG. 13(*b*) has a generally circular shape having a diameter larger than the outer diameter of the rod member 48. The toothed washer 50 has a central portion formed with an opening 100 engageable with the spiral groove 48*c*, and a hexapetalous teeth 101 through 106 each being bent outwardly (toward the base 41). Such petal form washer 50 is easily accessible in a market.

According to one modification to the toothed washer shown in FIG. 13(*c*), the washer 50A has a rectangular shape, and three teeth 101*a* to 103*a* are formed in one side, and another three teeth 104*a* to 106*a* are formed in opposite side.

Figure 14A:
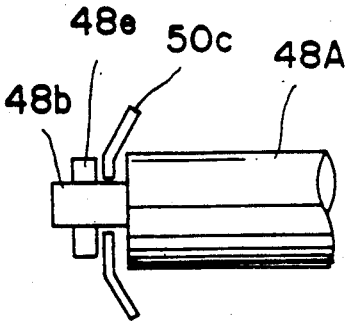
FIG. 14(*a*) is a schematic side view showing a tip end portion of a modified rod member and a modified toothed washer assembled thereto in the third embodiment of this invention.
Figure 14B:
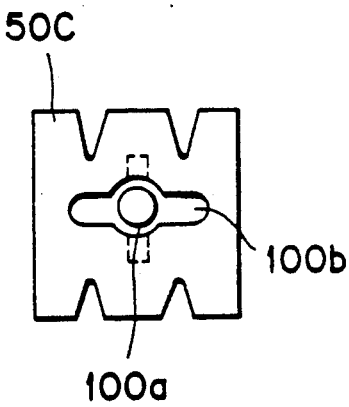
Figure 14C:
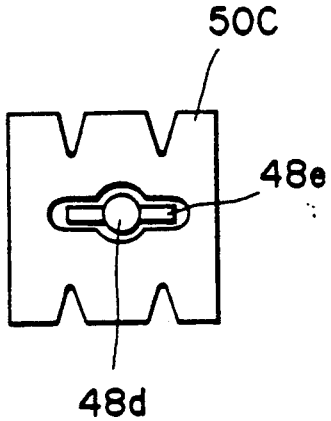

FIGS. 14(*a*) thru 14(*c*) show another example of a rod member 48A and a toothed washer 50*c* provided to the inner end portion of the rod member 48A. As shown in FIG. 14(*a*), the inner end portion of the rod member 48A is integrally provided with a small diameter rod 48*d* and a protrusion 48*e* extending therefrom for detachably engaging the modified toothed washer 50*c*. The modified toothed washer 50*c* has a rectangular shape and is formed with a central circular opening 100*a* and slits 100*b* intersecting the central circular opening. Further, three teeth are formed on one side of the washer, and another three teeth are formed on opposite side thereof. For engagement of the toothed washer 50*a* with the rod portion 48*d*, as shown in FIG. 14(*c*), the rod portion 48*d* and the protrusion 48*e* are respectively aligned with the central circular opening 100*a* and the slits 100*b*, respectively. Thereafter, as shown in FIG. 14(*b*), the rod member 48A and the toothed washer 50*c* are relatively angularly rotated by 90 degrees. Therefore, the protrusion 48*e* supports the plate portion of the washer for holding the washer to the rod member 48A.

Figure 15:
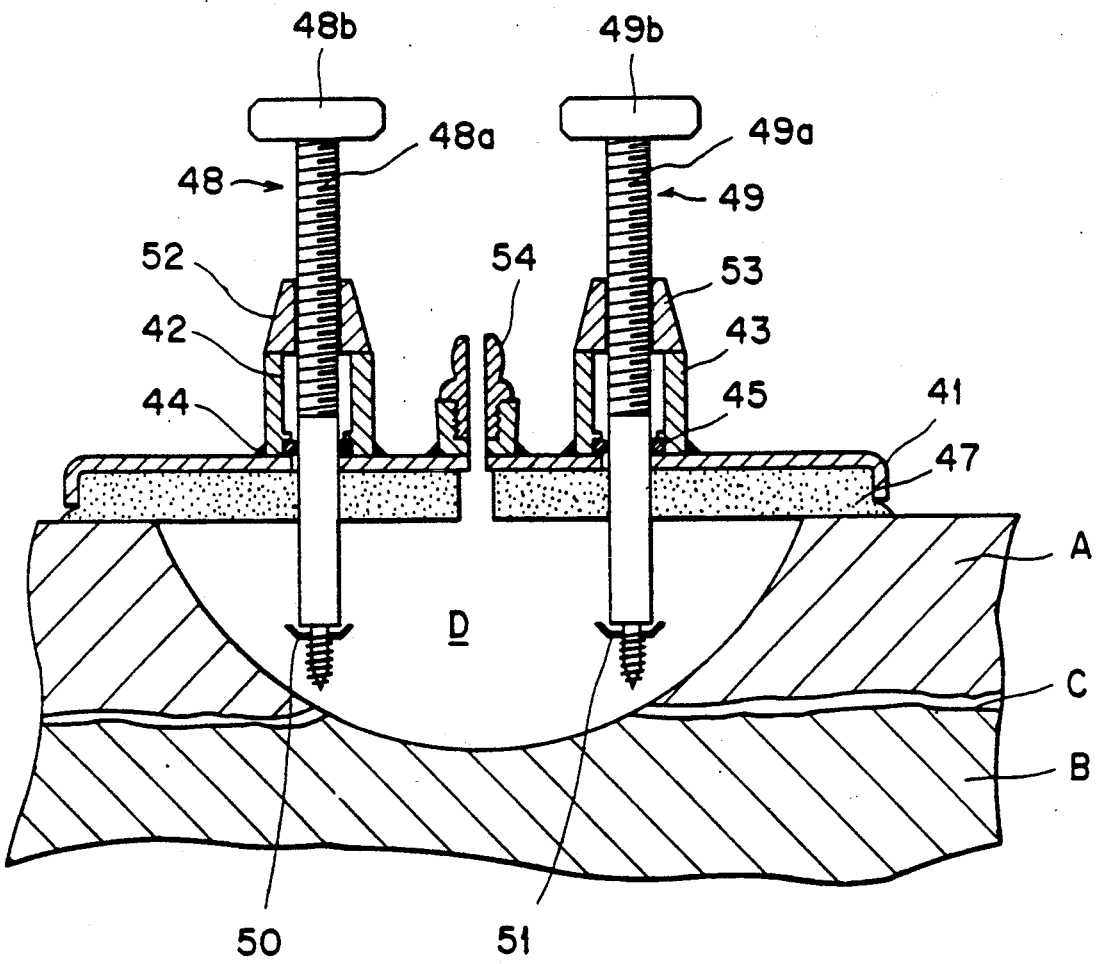
FIG. 15 is a cross-sectional view showing the plug device according to the third embodiment and showing a concrete wall construction to which the plug device is applied.
Figure 16:
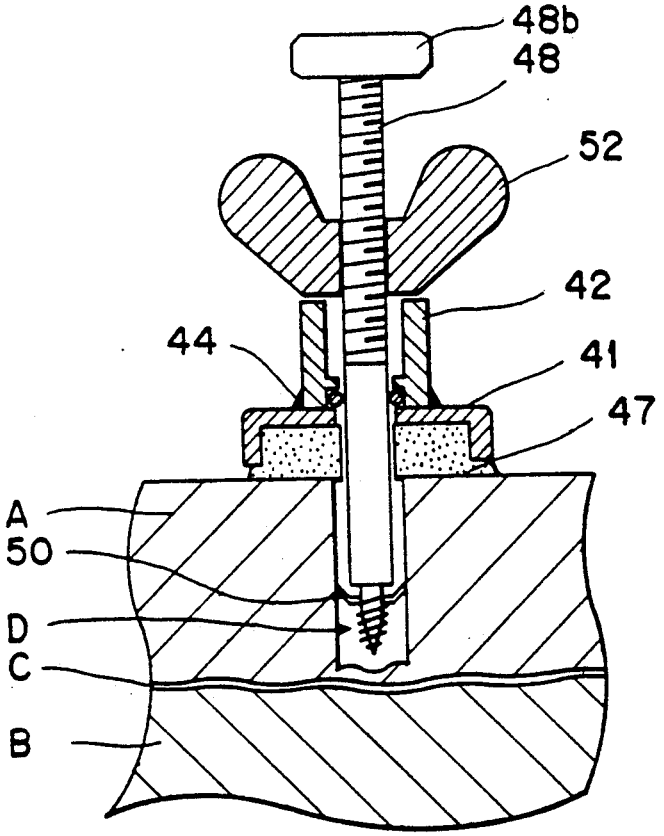
FIG. 16 is a cross-sectional view showing a part of the plug device according to the third embodiment after its fixed state to the concrete construction.

A method for injecting the concrete repairing agent into the separation space layer C with the employment of the plug device of the third embodiment will next be described with reference to FIGS. 15 through 17. The plug device is mounted on the concrete wall, and the hand grips 48*b*, 49*b* of the rod members 48, 49 are depressed inwardly, so that the tip end portions of the rod members are inserted into the injection groove D. In this case, since the toothed portions of the toothed washers are bent outwardly, and since the width of the washers is made smaller than that of the groove D, the toothed washers 50, 51 can be smoothly inserted into the groove D.

Next, wing nuts 52, 53 are rotated in a clockwise direction, so that the wing nuts 52, 53 are threadingly moved inwardly in the axial direction of the rod members along the threads 48*a*, 49*b*. The inward movement (downward movement in FIG. 16) of the wing nuts 52, 53 are prevented when these are brought into abutment with planar outer ends of the guide posts 42, 43. Thereafter, in accordance with the further rotations of the wing nuts 52, 53, the rod members 48, 49 are moved outwardly (upwardly in FIG. 16) along axial direction thereof. In this case, as shown in FIG. 16, the teeth of the toothed washers 50, 51 are gradually threaded into the side walls of the injection grooves with their resilient deformations, since the toothed portions are bent outwardly, and finally, the axially outward movements of the rod members 48, 49 are prevented because of the sufficient engagements of the toothed washers with the groove wall. Thus, the plug device is securely fixed to the concrete wall. By further rotating the wing nuts 52, 53, the base 41 is urgedly moved inwardly, so that the packing 47 is sufficiently compressed. Accordingly, fluid-tight fixing work of the plug device to the concrete wall is completed.

Figure 17:
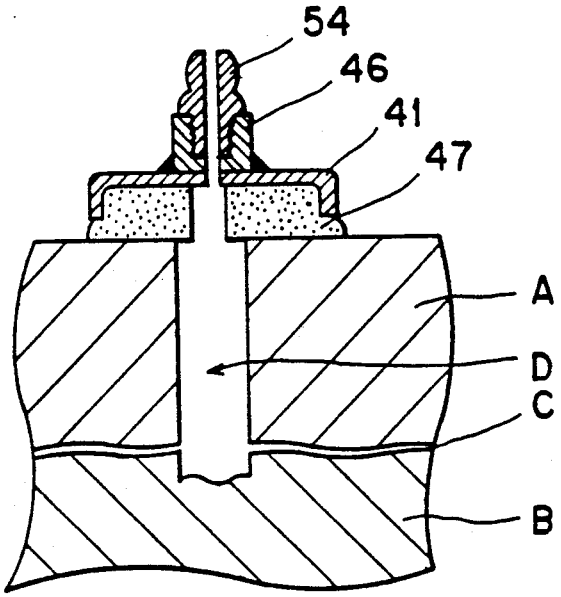
FIG. 17 is a cross-sectional view showing injection part of the plug device according to the third embodiment.

Then, an injection hose (not shown) extending from an injection pump (not shown) is coupled to the injection nipple 54, and low pressure injection of cement slurry is initiated with a state shown in FIG. 17. As a result, the separation space layer C as well as the injection groove D are filled with the cement slurry. Upon completion of the injection work, the rod members 48, 49 are rotated about their axes in counterclockwise direction by manually rotating the hand grips 48*b*, 49*b* in this direction. Therefore, the toothed washers 51, 52 are disengaged from the tip end (inner end) portions of the rod members 48, 49. Then, the rod members 48, 48 are pulled outwardly from the injection groove D, while the disengaged toothed washers 50, 51 are remained within the groove D. Thus, the plug device is dismounted from the concrete wall.

While the invention has been described in detail and with reference to specific embodiment thereof, it would be apparent to those skilled in the art that various changes and modifications may be made therein without departing from the spirit and scope of the invention.

What is claimed is:

1. A method for injecting a concrete repairing agent into a concrete construction comprising the steps of:

forming an injection groove which is arcuate in cross-section on an outer surface of the concrete construction, the arcuate groove having a first width, a length and a depth, said length being substantially larger than said first width;

placing a base member of an injection plug device which injects the repairing agent into the concrete construction onto the outer surface of the concrete construction and over an entire open portion of the injection groove;

fixing the injection plug device to the arcuate injection groove while sealingly covering the arcuate injection groove with said base member by attaching said injection device to walls of the injection groove with engageable means by inserting said engageable means into the injection groove and subsequently deforming the engageable means with means for deformation, the engageable means having a second width, which is smaller than the first width, before deformation thereof by said deforming means and having a third width, which is larger than the first width, after deformation thereof by said deforming means; and injecting the repairing agent, under pressure, into the injection groove through the injection plug device.

2. The method as claimed in claim 1, wherein the injection groove is formed by using dual blade type concrete cutter.

3. The method as claimed in claim 1, wherein the forming step comprises the steps of:

forming at least two cutting grooves in parallel to each other with a circular concrete saw; and removing at least a part of the concrete construction positioned between the two cutting grooves to form the arcuate groove.

4. A method for injecting a concrete repairing agent into a concrete construction comprising the steps of:

forming an arcuate injection groove from an outer surface of the concrete construction, the arcuate groove having a first width and a depth;

placing an injection plug device which injects the repairing agent into the concrete construction onto the outer surface of the concrete construction and over the injection groove;

fixing the injection plug device to the arcuate injection groove while sealingly covering the arcuate injection groove; and pressurizingly injecting the repairing agent into the injection groove through the injection plug device, the injection plug device being provided with a base member for covering an open end of the arcuate injection groove ad engageable means engageable with the arcuate injection groove, the engageable means having a second width, which is smaller than the first width, before deformation thereof and a third width, which is larger than the first width, after deformation thereof, and the placing step comprising the steps of:

inserting the engageable means into the arcuate injection groove, the fixing step comprising the steps of:

deforming the engageable means after it has been inserted into the arcuate injection groove for engaging the engageable means with the arcuate injection groove; and mechanically urging the base member toward the outer surface of the concrete construction and around the open end of the arcuate injection groove and mechanically maintaining the urging to provide a hermetical seal between the base member and the injection groove.

5. The method as claimed in claim 4, wherein said mechanically urging step further comprises the step of interposing a resilient member between the base member and the outer surface of the concrete construction.

6. The method as claimed in claim 4, wherein the arcuate injection groove is formed using a dual blade type concrete cutter.

* * * * *